US009837241B2

(12) United States Patent
Liu et al.

(10) Patent No.: US 9,837,241 B2
(45) Date of Patent: Dec. 5, 2017

(54) TERA HERTZ REFLEX KLYSTRON

(71) Applicants: Tsinghua University, Beijing (CN); HON HAI PRECISION INDUSTRY CO., LTD., New Taipei (TW)

(72) Inventors: Peng Liu, Beijing (CN); Pi-Jin Chen, Beijing (CN); Zong-Qian Li, Beijing (CN); Duan-Liang Zhou, Beijing (CN); Chun-Hai Zhang, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/183,175

(22) Filed: Jun. 15, 2016

(65) Prior Publication Data

US 2017/0062170 A1 Mar. 2, 2017

(30) Foreign Application Priority Data

Aug. 25, 2015 (CN) ..... 2015 1 0525276

(51) Int. Cl.

| | |
|---|---|
| ***H01J 23/06*** | (2006.01) |
| ***H01J 25/22*** | (2006.01) |
| ***H01J 31/12*** | (2006.01) |
| ***H01J 3/02*** | (2006.01) |
| ***H01J 23/08*** | (2006.01) |

(52) U.S. Cl.

CPC ..... *H01J 25/22* (2013.01); *H01J 3/021* (2013.01); *H01J 23/08* (2013.01); *H01J 31/127* (2013.01)

(58) Field of Classification Search

CPC .. H01J 3/021; H01J 23/08; H01J 25/22; H01J 31/127

USPC ..... 313/495, 496, 497, 311

See application file for complete search history.

(56) References Cited

U.S. PATENT DOCUMENTS

| | | | | | |
|---|---|---|---|---|---|
| 5,578,900 | A * | 11/1996 | Peng | H01J 7/16 | 313/309 |
| 5,844,360 | A * | 12/1998 | Jeong | H01J 29/94 | 313/336 |
| 5,932,972 | A * | 8/1999 | Symons | H01J 1/46 | 313/293 |
| 2004/0150311 | A1* | 8/2004 | Jin | H01J 1/304 | 313/309 |
| 2005/0236963 | A1* | 10/2005 | Kang | B82Y 10/00 | 313/495 |

(Continued)

FOREIGN PATENT DOCUMENTS

CN 104103476 10/2014

*Primary Examiner* — Tung X Le

(74) *Attorney, Agent, or Firm* — Steven Reiss

(57) ABSTRACT

A Tera Hertz reflex klystron includes an electron emission unit, a resonant unit and an output unit. The electron emission is used to emit a plurality of electrons. The electron emission unit defines a first opening. The resonant unit comprises a resonant cavity frame. The resonant cavity frame comprises a top wall and a bottom wall and defines a resonant cavity. The top wall and the bottom wall faces with each other. The bottom wall comprises a bottom opening. The top wall comprises a top opening and at least one outputting hole. The bottom opening and the first opening are merged with each other. The output unit being configured to output Tera Hertz waves. The plurality of electrons are transferred to the output unit from the at least one outputting hole.

20 Claims, 5 Drawing Sheets

(56) References Cited

U.S. PATENT DOCUMENTS

2006/0202606 A1* 9/2006 Sobieradzki ..... H01J 23/10
313/495
2016/0190293 A1* 6/2016 Wu ..... H01L 29/66242
257/197

* cited by examiner

TERA HERTZ REFLEX KLYSTRON

CROSS-REFERENCE TO RELATED APPLICATIONS

This application claims all benefits accruing under 35 U.S.C. §119 from China Patent Application No. 201510525276.6, filed on Jun. 25, 2015 in the China Intellectual Property Office, disclosure of which is incorporated herein by reference.

BACKGROUND

1. Technical Field

The present disclosure relates to a Tera Hertz reflex klystron and a micro Tera Hertz reflex klystron array.

2. Description of Related Art

In general, the Tera Hertz (THz) wave refers to an electromagnetic wave whose frequency ranging from 0.3 THz to 3 THz or 0.1 THz to 10 THz. The band of THz wave lies between the infrared wave and the millimeter wave. The THz wave has excellent properties. For example, THz wave has certain ability to penetrate objects, and the photon energy is small, thus the THz will not cause damage to the objects. At the same time, a lot of material can absorb the THz wave.

A reflex klystron is used to emit electromagnetic waves. In order to emit THz waves, the feature size of the reflex klystron should be small and the current density of the electron rejection should be high. A traditional Tera Hertz reflex klystron includes a resonant cavity. The resonant cavity includes two coupling outputting holes located on two opposite side walls. The resonant cavity should have a large width, and the size of the Tera Hertz reflex klystron should be large enough. It is hard to decrease the size of the Tera Hertz reflex klystron, and a micro Tera Hertz reflex klystron array cannot be obtained.

What is needed, therefore, is a Tera Hertz reflex klystron that overcomes the problems as discussed above.

A Tera Hertz reflex klystron is provided, which includes: an electron emission unit being configured to emit a plurality of electrons, the electron emission unit defines a first opening; a resonant unit comprising a resonant cavity frame, the resonant cavity frame comprises a top wall and a bottom wall and defining a resonant cavity; the top wall and the bottom wall facing each other; and the bottom wall comprising a bottom opening, the top wall comprising a top opening and at least one outputting hole, and the bottom opening and the first opening are merged with each other; an output unit being configured to output Tera Hertz waves, and the plurality of electrons are transferred to the output unit from the at least one outputting hole.

Compared with the conventional Tera Hertz reflex klystron, the Tera Hertz reflex klystron includes at least one outputting hole. The at least one outputting hole is located on the top wall of the resonant cavity frame, a width of the resonant cavity frame can be small, and as such, the Tera Hertz reflex klystron can have a small size.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present ionization electron emission unit.

Figure 1:
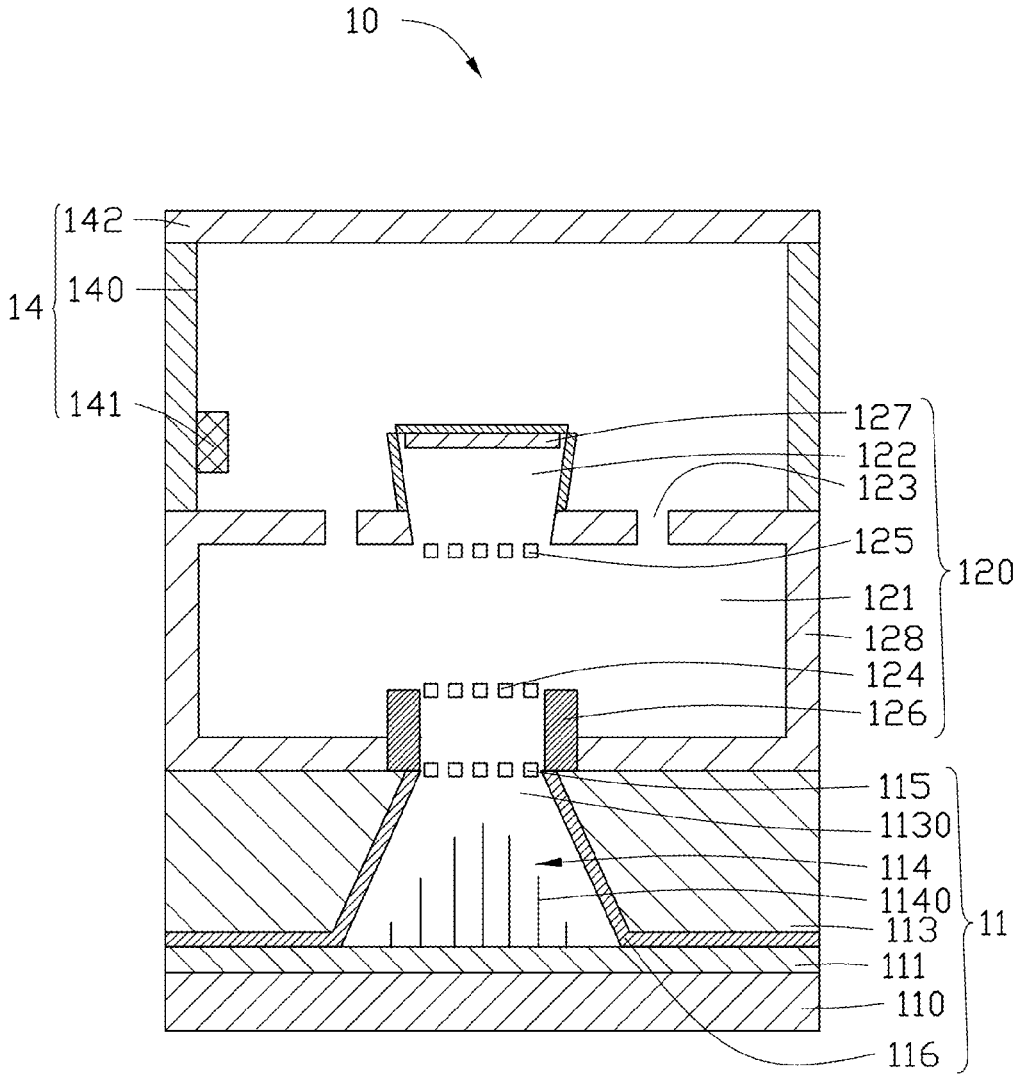
FIG. 1 is a schematic section view of one embodiment of a Tera Hertz reflex klystron.

Referring to FIG. 1, a Tera Hertz reflex klystron 10, according to one embodiment, is provided. The Tera Hertz reflex klystron 10 includes an electron emission unit 11, a resonant unit (not labeled) and an output unit 14. The electron emission unit 11, the resonant unit and the output unit 14 connect with each other. The resonant unit is located between the electron emission unit 11 and the output unit 14. The electron emission unit 11 is used to emit electrons. The resonant unit includes a resonant cavity 121 which is connected with the electron emission unit 11. The electrons are emitted from the electron emission unit 11 and get into the resonant cavity 121. The resonant cavity 121 includes at least one outputting holes 123. The output unit 14 and the resonant unit 12 face each other. The output unit 14 and the resonant unit 12 are communicant with each other through the outputting holes 123. The resonant unit emits Tera Hertz (THz) waves which are transmitted to the output unit 14.

The electron emission unit 11 includes an insulating substrate 110, a cathode 111, an electron emitter unit 114, an electron injection layer 113, an insulating layer 116, and an electron extraction grid 115. The cathode 111 is located on the insulating substrate 110. The electron emitter unit 114 is electrically connected to the cathode 111. The electron injection layer 113 is located above and insulated from the cathode 111 via the insulating layer 116. The electron injection layer 113 defines a hollow space 1130, and the electron emitter unit 114 is located in the hollow space 1130. The hollow space 1130 defines a first opening, the electron extraction grid 115 covers the first opening.

A material of the insulating substrate 110 can be silicon, glass, ceramics, plastics, or polymers. A shape and a thickness of insulating base can be selected according to actual needs. The shape of the insulating substrate 110 can be circular, square, or rectangular. In one embodiment, the insulating substrate 110 is square, the length is about 10 mm, and the thickness is about 1 mm.

The cathode 111 is located on a surface of the insulating substrate 110. The insulating layer 116 covers the cathode 111. A first portion of the cathode 111 is exposed to and faces the electron extraction grid 115, and a second portion of the cathode 111 is covered by the electron injection layer 113. The electron emitter unit 114 is located on the first portion of the cathode 111 and electrically connected to the cathode 111. The electron emitter unit 114 faces the electron extraction grid 115. The first portion of the cathode 111 is exposed out through the hollow space 1130.

The cathode 111 is a conductive layer. A material of the cathode 111 can be pure metal, alloy, semiconductor, indium tin oxide, or conductive paste. In one embodiment, the material of the insulating substrate 110 is silicon, and the cathode 111 can be doped silicon. In one embodiment, the material of the cathode 111 is an aluminum film with 20 micrometers. The aluminum film can be deposited on the insulating substrate 110 via magnetron sputtering method.

A material of the electron injection layer 113 can be silicon, chromium. A thickness of the electron injection layer 113 can be greater than 10 micrometers. In one embodiment, the thickness of the electron injection layer 113 ranges from about 30 micrometers to about 60 micrometers.

The electron injection layer 113 can have an oblique sidewall around the hollow space 1130. The hollow space 1130 can be in a shape of inversed funnel, and the size of hollow space 1130 is gradually narrowed along a direction away from the cathode 111. The electron emitter unit 114 can be received in hollow space 1130.

The insulating layer 116 located on a surface of the electron injection layer 113. The insulating layer 116 has two potions, a first portion of the insulating layer 116 is located between the electron injection layer 113 and the cathode 111, a second portion of the insulating layer 116 is located in the hollow space 1130 and on an inside surface of the electron injection layer 113. The insulating layer 116 can be resin, plastic, glass, ceramic, oxide, or their mixture. The oxide can be silica, aluminum oxide, or bismuth oxide. In one embodiment, the thickness of insulating layer 116 is about 100 micrometers. The material of the insulating layer 116 is a circular photoresist. In one embodiment, a secondary electron multiply material can be coated on a surface of the second portion of the insulating layer 116. The secondary electron multiply material can be magnesium oxide, beryllium oxide or diamond. The secondary electron multiply material can improve number of the electrons when the electrons emitted from the electron emitters 1140 hit the side wall of the hollow space 1130.

Figure 2:
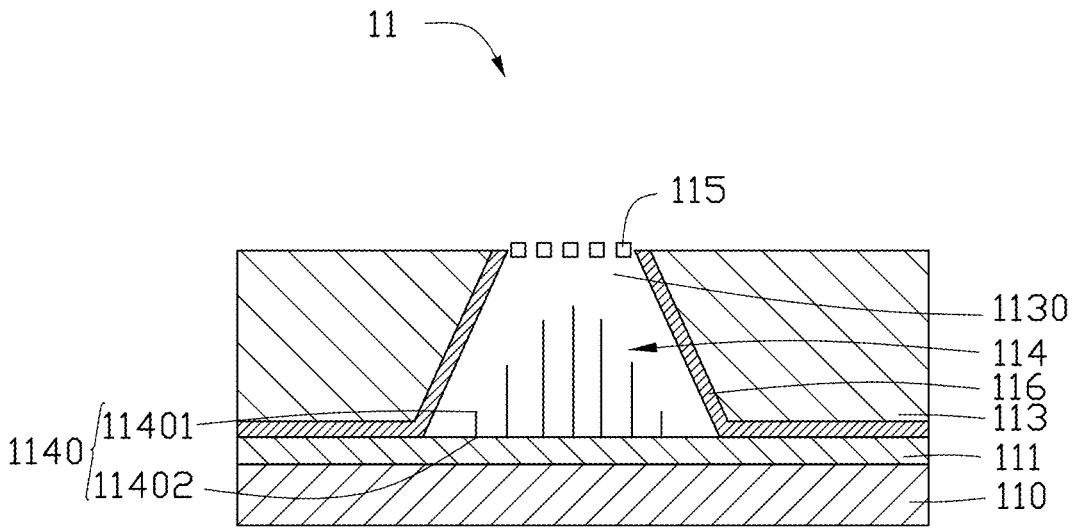
FIG. 2 is a schematic view of an electron emission unit used in the Tera Hertz reflex klystron of FIG. 1.

Referring to FIG. 2, the electron emitter unit 114 has a tapered shape defining a peak. A height of the electron emitter unit 114 at the central portion is the highest, and the height is gradually decreased along a direction away from the center. Furthermore, the central portion of the electron emitter unit 114 and the center of hollow space 1130 are in a same location. The electron emitter unit 114 includes a plurality of electron emitters 1140. The plurality of electron emitters 1140 are parallel with each other. The electron emitter 1140 at the center of the electron emitter unit 114 is the highest. The height of the electron emitter unit 114 are gradually decreased along the direction away from the center of the electron emitter unit 114.

The material of the electron emitters 1140 can be carbon nanotube, carbon fiber, or silicon nanofiber. Each of the plurality of electron emitters 1140 includes a first end and a second end, opposite to the first end. The second end is adjacent and electrically connected to the cathode 111, and the first end extends toward the anode 112. The first end is configured to emit electrons as an electron emission terminal. The height of the plurality of electron emitter unit 114 is greater than the thickness of the insulating layer 116.

Figure 3:
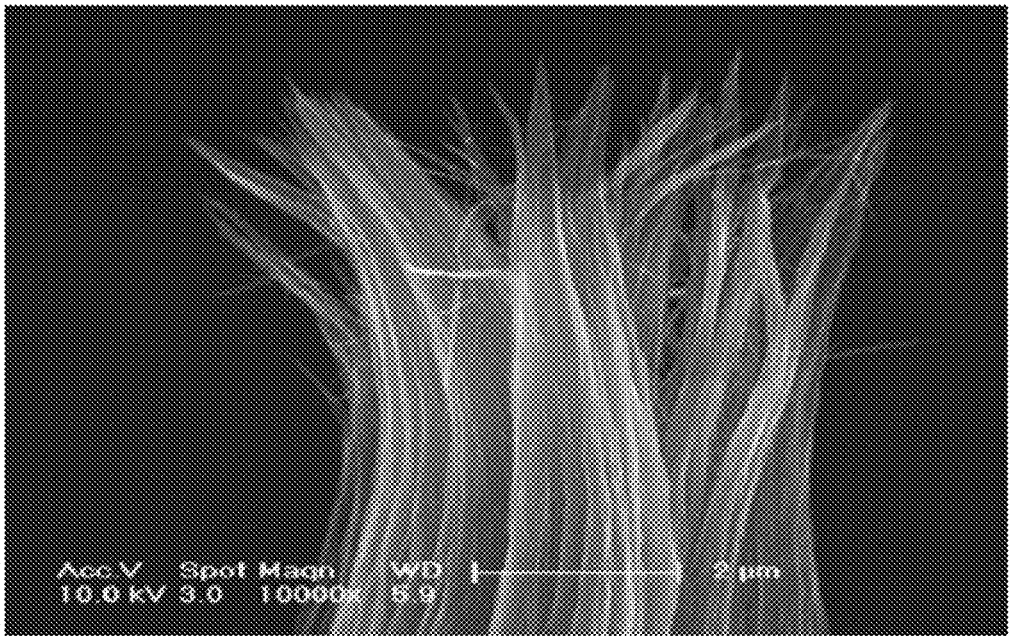
FIG. 3 is an scanning electron microscope (SEM) image of a carbon nanotube wire used in the electron emission unit of FIG. 2.

The electron emitter unit 114 is spaced from the sidewall of hollow space 1130. The electron emitter unit 114 defines an emitting surface that is away from the insulating substrate 110. The emitting surface of the electron emitter unit 114 can be parallel with the sidewall. In detail, a distance between each first end of the electron emitters 1140 and the sidewall of hollow space 1130 is substantially the same. Thus the plurality of first ends and the sidewall have substantially the same distances. The electron emitters 1140 can be carbon nanotubes, carbon fibers, silicon nanowires or silicon tips. Referring to FIG. 3, in one embodiment, the electron emitter unit 114 can be a carbon nanotube wire. The carbon nanotube wire includes a plurality of carbon nanotubes parallel with each other or twisted with other.

Furthermore, an ion bombardment resistance material can be deposited on each of the plurality of electron emitters 1140. The ion bombardment resistance material can be zirconium carbide, hafnium carbide, or lanthanum hexaboride. The ion bombardment resistance material can protect the plurality of electron emitters 1140 from damage. Thus the lifespan of the electron emitters 1140 can be prolonged.

The electron emission unit 11 can further include a resistor layer (not shown). The resistor layer is sandwiched between the electron emitter unit 114 and the cathode 111. The electron emitter unit 114 is electrically connected to the cathode 111. The resistance of the resistor layer is greater than 10GΩ to ensure that the cathode 111 can uniformly apply current to the electron emitter unit 114. The material of the resistor layer can be metallic alloy of nickel, copper, cobalt; the material of the resistor layer can also be metallic alloy, metallic oxide, inorganic composition doped with phosphorus.

The electron extraction grid 115 is used to leading the electrons emitter from the electron emitter unit 114. The electron extraction grid 115 is spaced from the electron injection layer 113 and cover the first opening of the hollow space 1130. While a voltage is applied on the electron extraction grid 115, the electrons can be extracted from the electron emitter unit 114.

Figure 4:
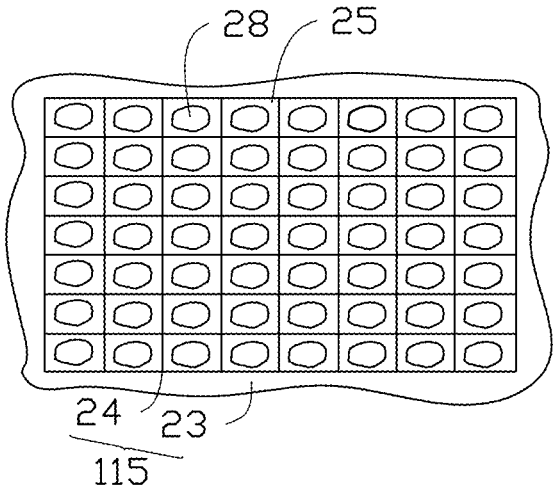
FIG. 4 shows a vertical view of a first grid according to one embodiment.

The electron extraction grid 115 can be a carbon nanotube composite layer, a carbon nanotube layer, or a graphene layer. An electron transmittance rate of the graphene layer can reach to 98%. Referring to FIG. 4, in one embodiment, the electron extraction grid 115 is a carbon nanotube composite layer. The carbon nanotube composite layer has a net structure comprising a carbon nanotube layer 24 and coating layer 23.

The carbon nanotube composite structure defines a plurality of apertures 28 to let the electrons pass through. A size of the aperture 28 can range from about 1 nanometer to about 200 micrometers, particularly, it is ranged from 10 nanometers to 10 millimeters.

The carbon nanotube layer forms a pattern. The patterned carbon nanotube layer defines the plurality of holes 25. The holes 25 can be dispersed uniformly. The holes 25 extend throughout the carbon nanotube layer along the thickness direction thereof. The holes 25 can be defined by several adjacent carbon nanotubes, or a gap defined by two substantially parallel carbon nanotubes and extending along axial direction of the carbon nanotubes. The coating layer 23 is coated on the plurality of carbon nanotubes in the carbon nanotube layer. After the coating layer formed, the size of the holes 25 decreases to form the apertures 28. The coating layer 23 is used to protect the carbon nanotube layer 24. A material of the coating layer 23 can be silicon, silicon dioxide, silicon oxide, or aluminum oxide. A thickness of the coating layer 23 ranges from 1 nanometer to 100 micrometers, particularly, it ranges from 5 nanometers to 100 nanometers.

The resonant unit 12 includes a resonant cavity frame 128, an insulating support 126, a first grid electrode 124, a second grid electrode 125, at least one outputting hole 123, a reflective room 122 and a reflective electrode 127. The resonant cavity frame 128 defines a resonant cavity 121. The resonant cavity frame 128 is located on and above the electron injection layer 113. The resonant cavity frame 128 defines a bottom opening (not labeled) and a top opening (not labeled). The first opening, the bottom opening and the top opening are running through with each other. The bottom opening is located above the first opening. The bottom opening and the first opening are merged with each other. The insulating support 126 is located around the bottom opening. The first grid electrode 124 is located above and parallel with the electron extraction grid 115. The first grid electrode 124 is supported by the insulating support 126 separated from the electron extraction grid 115.

A material of the resonant cavity frame 128 can be silicon or chromium. A width of the resonant cavity 121 can be in a range of 70 micrometers to 300 micrometers. A inside wall of the resonant cavity frame 128 is coated by metal, such as copper, aluminum and other conductive material. In one embodiment, the resonant cavity frame 128 has a tube structure defines the resonant cavity 121. A diameter of the resonant cavity 121 is 300 micrometers, the output frequency.

The resonant cavity frame 128 includes a bottom wall and a top wall. The bottom wall is located on the electron extraction grid 115. The top wall is located above the bottom wall. The bottom opening is defined by the bottom wall. The top opening is defined by the top wall. The at least one outputting hole 123 is located in the top wall. The second grid electrode 125 covers the top opening. The electron extraction grid 115, the first grid electrode 124 and the second grid electrode 125 are arranged in that order and overlapped with each other.

The at least one outputting hole 123 is located around the top opening. In some embodiments, the at least one outputting hole includes a plurality of outputting holes arranged orderly, the plurality of outputting holes are arranged uniformly on a circle, and a center of the circle is a center of the top opening. In the embodiment, a number of the outputting hole 123 is four, and the four outputting holes 123 are arranged in symmetry.

The reflective room 122 includes a reflective electrode 127 located therein. The reflective electrode 127 is located above and faces the second grid electrode 125. The reflective room 122 covers the top opening and open to the top opening. When a voltage is applied on the reflective electrode 127, the reflective electrode 127 is used to reflect electrons passing through the second grid electrode 125. A voltage of the reflective electrode 127 is lower than a voltage of the second grid electrode 125. And, a speed of the electrons getting into the reflective room 122 is decreased by a retarding field between the reflective electrode 127 and the second grid electrode 125.

The output unit 14 includes a wave guide 140, an absorber 141 and a lens 142. The wave guide 140 defines a guide room, the absorber 141 is located on a surface of the wave guide 140 and in the guide room. The lens 142 is located at one end of the wave guide and covers an exit of the guide room.

In use of the Tera Hertz reflex klystron, the cathode 111, the electron extraction grid 115, the first grid electrode 124, the second grid electrode 125, the reflective electrode 127 are separately applied voltage. The electrons are emitted by the electron emitter unit 114 and extracted out the first opening by the electron extraction grid 115, and, pass through the first grid electrode 124. The electrons can be accelerated by the first grid electrode 124 and the second grid electrode 125 to form an electron beam with enough current density. The electron beam can pass through the first grid electrode 124, the resonant cavity 121, and the second grid electrode 125. Thus the electron beam will be modulated by a microwave field in the resonant cavity 121. After the electron beam passes through the second grid electrode 125, the electron beam will be reflected by the reflective electrode 127. All the electrons will be reflected by the retarding field in the reflective room 122. Thus the electron beam will be modulated on density in the retarding field and reflected to the resonant cavity 121. Therefore, the electrons will be oscillated in the resonant cavity 121. After the electron beam is modulated on density, it will pass through the outputting hole 123 be transferred out into the guide room of the output unit 14. And, then the Tera Hertz will be formed and output from the lens.

The Tera Hertz reflex klystron 10 has following advantages. The at least one outputting hole 123 is located on the top wall of the resonant cavity frame 128, a width of the resonant cavity frame 128 can be small, and as such, the Tera Hertz reflex klystron 10 can have a small size. Further, because the electron emitter structure has a shape of cone, and the electron emitter in the central portion is highest, thus the shielding effect can be reduced. In addition, the through hole of the electron extraction grid 115 is in the shape of inversed funnel, thus the electrons can be focused by the through hole, and the current emission density can be improved.

Figure 5:
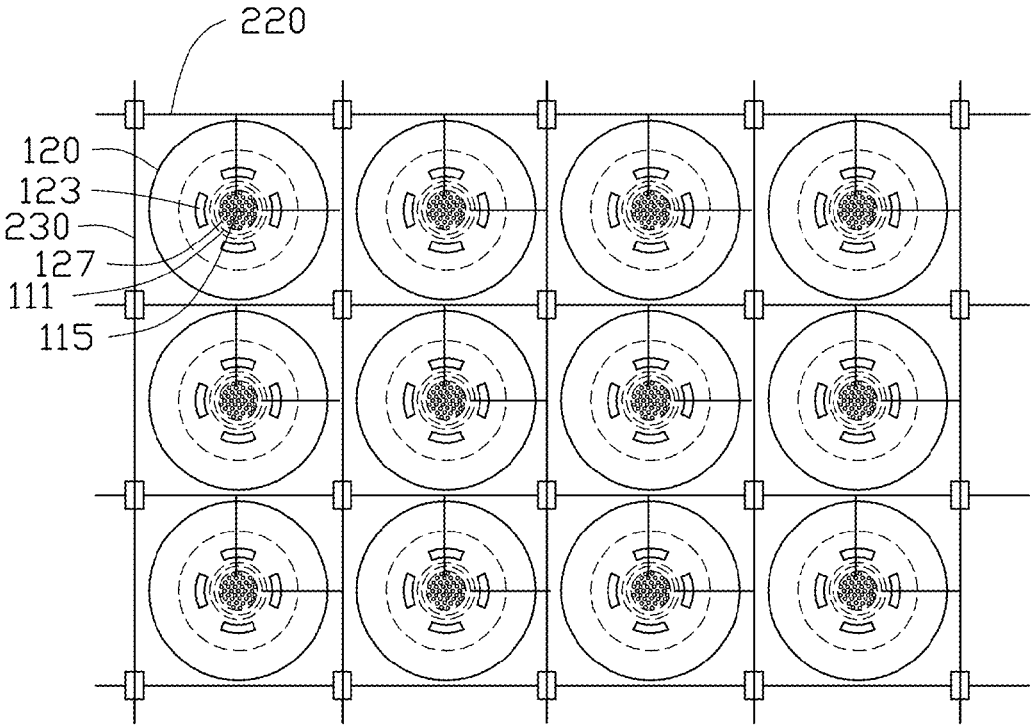
FIG. 5 shows a vertical schematic view of one embodiment of a micro Tera Hertz reflex klystron array.

Referring to FIG. 5, a micro Tera Hertz reflex klystron array 20 according to on embodiment is provided. The micro Tera Hertz reflex klystron array includes a substrate 210, a plurality of first electrodes 220, a plurality of second electrodes 230, and a plurality of Tera Hertz reflex klystrons 10.

The plurality of first electrodes 220 are parallel with each other. The plurality of second electrodes 230 are parallel with each other. The plurality of first electrodes 220 and the plurality of second electrodes 230 are perpendicular with each other to from a grid structure. The grid structure includes a plurality of cells. Each cell is defined by adjacent first electrodes 220 and adjacent second electrodes 230. Each Tera Hertz reflex klystrons 10 is located in the cell and electrically connected with one first electrode 220 and one second electrode 230.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A Tera Hertz reflex klystron, comprising:

an electron emission unit being configured to emit a plurality of electrons, the electron emission unit defines a first opening, wherein the electron emission unit comprises a cathode, an electron emitter unit, and an electron injection layer; and the electron emitter unit is electrically connected with the cathode, the electron injection layer defines a hollow space having the first opening, and the electron emitter unit is located in the hollow space;

a resonant unit comprising a resonant cavity frame, the resonant cavity frame comprises a top wall and a bottom wall and defining a resonant cavity; the top wall and the bottom wall facing each other; and the bottom wall comprising a bottom opening, the top wall comprising a top opening and at least one outputting hole, and the bottom opening and the first opening are merged with each other; and an output unit being configured to output Tera Hertz waves, and the plurality of electrons are transferred to the output unit from the at least one outputting hole.

2. The Tera Hertz reflex klystron of claim 1, wherein the first opening, the bottom opening and the top opening are co-axial.

3. The Tera Hertz reflex klystron of claim 1, wherein at least one outputting hole comprises a plurality of outputting holes arranged orderly, the plurality of outputting holes are central symmetry around a center of the top opening.

4. The Tera Hertz reflex klystron of claim 1, wherein the electron emission unit further comprises an electron extraction grid, and the electron extraction grid covers the first opening.

5. The Tera Hertz reflex klystron of claim 4, wherein the electron extraction grid is a carbon nanotube composite layer, a carbon nanotube layer, or a graphene layer.

6. The Tera Hertz reflex klystron of claim 5, wherein the electron extraction grid is a carbon nanotube composite layer comprising a carbon nanotube layer and a coating layer, and the carbon nanotube composite layer defines a plurality of apertures.

7. The Tera Hertz reflex klystron of claim 1, further comprising an insulating layer located on a surface of the electron injection layer; and the insulating layer comprises two potions, a first portion of the insulating layer is located between the electron injection layer and the cathode, and a second portion of the insulating layer is located in the hollow space and on an inside surface of the electron injection layer.

8. The Tera Hertz reflex klystron of claim 1, wherein the hollow space is in a shape of inversed funnel, and the size of hollow space is gradually narrowed along a direction away from the cathode.

9. The Tera Hertz reflex klystron of claim 1, wherein the electron emitter unit is in a tapered shape with a peak and comprises a plurality of electron emitters, one of the plurality of electron emitters, in a center of the electron emitter unit, is the highest.

10. The Tera Hertz reflex klystron of claim 9, wherein a height of each of the plurality of electron emitters is gradually decreased along a direction away from the center.

11. The Tera Hertz reflex klystron of claim 1, wherein the electron emitter unit is a carbon nanotube wire comprising a plurality of carbon nanotubes parallel with each other or twisted with other.

12. The Tera Hertz reflex klystron of claim 1, wherein the resonant unit further comprises an insulating support, a first grid electrode, a second grid electrode, a reflective room and a reflective electrode; the insulating support is located around the bottom opening; the first grid electrode is located on the insulating support; the second grid electrode covers the top opening; the reflective room covers the top opening and open to the top opening; and the reflective electrode is located in the reflective room.

13. The Tera Hertz reflex klystron of claim 12, wherein the reflective electrode is located above and faces the second grid electrode.

14. A micro Tera Hertz reflex klystron array, comprising:

a substrate;

a plurality of first electrodes and a plurality of second electrodes located on the substrate;

a plurality of Tera Hertz reflex klystrons electrically connected with the plurality of first electrodes and the plurality of second electrodes; and each Tera Hertz reflex klystron comprises an electron emission unit being configured to emit a plurality of electrons, and the electron emission unit defines a first opening;

a resonant unit comprising a resonant cavity frame, the resonant cavity frame comprises a top wall and a bottom wall and defining a resonant cavity; the top wall and the bottom wall faces with each other; the bottom wall comprising a bottom opening; the top wall comprising a top opening and at least one outputting hole; and the bottom opening and the first opening are merged with each other; and an output unit being configured to output Tera Hertz waves, so that the plurality of electrons are transferred to the output unit from the at least one outputting hole.

15. The micro Tera Hertz reflex klystron array of claim 14, wherein the plurality of first electrodes and the plurality of second electrodes are perpendicular with each other to from a grid structure.

16. The micro Tera Hertz reflex klystron array of claim 15, wherein the grid structure comprises a plurality of cells, each cell is defined by adjacent first electrodes and adjacent second electrodes, and each Tera Hertz reflex klystrons is located in the cell and electrically connected with one first electrode and one second electrode.

17. The micro Tera Hertz reflex klystron array of claim 14, wherein the electron emission unit comprises a cathode, an electron emitter unit, and an electron injection layer; and the electron emitter unit is electrically connected with the cathode.

18. The micro Tera Hertz reflex klystron array of claim 17, wherein the electron injection layer defines a hollow space having the first opening, the electron emitter unit is located in the hollow space.

19. The micro Tera Hertz reflex klystron array of claim 17, wherein the electron emitter unit has a tapered shape with a peak and comprises a plurality of electron emitters; and one of the plurality of electron emitters, in a center of the electron emitter unit, is the highest.

20. The micro Tera Hertz reflex klystron array of claim 17, wherein the electron emitter unit is a carbon nanotube wire comprising a plurality of carbon nanotubes parallel with each other or twisted with other.

* * * * *